US007086755B2

(12) United States Patent
Lin

(10) Patent No.: US 7,086,755 B2
(45) Date of Patent: Aug. 8, 2006

(54) POSITIONING STRUCTURE OF A FRAME WITH BULBS

(76) Inventor: Fong-Shi Lin, 2F-1, No. 152, Nan Yar Street, Hsinchu City (TW)

( * ) Notice: Subject to any disclaimer, the term of this patent is extended or adjusted under 35 U.S.C. 154(b) by 485 days.

(21) Appl. No.: 10/704,614

(22) Filed: Nov. 12, 2003

(65) Prior Publication Data

US 2005/0099809 A1 May 12, 2005

(51) Int. Cl.
*F21V 21/00* (2006.01)

(52) U.S. Cl. ..... 362/249; 362/640; 362/653

(58) Field of Classification Search ..... 362/249, 362/250, 285, 653, 654
See application file for complete search history.

(56) References Cited

U.S. PATENT DOCUMENTS 5,993,025 A * 11/1999 Huang ..... 362/249
6,062,707 A * 5/2000 Wang ..... 362/249
6,183,110 B1 * 2/2001 Chang ..... 362/249
6,428,184 B1 * 8/2002 Huang ..... 362/657

* cited by examiner

*Primary Examiner*—Ali Alavi
*Assistant Examiner*—Hargobind S. Sawhney
(74) *Attorney, Agent, or Firm*—Rosenberg, Klein & Lee

(57) ABSTRACT

The invention relates to a positioning structure of a frame with a bulb assembly, which utilizes a positioning structure provided on the frame and the bulb holder of the bulb assembly for easily engaging both firmly. Hence, the light string with many bulb assemblies can be positioned with the patterned frame conveniently that obtains predicted purpose for decoration.

3 Claims, 5 Drawing Sheets

POSITIONING STRUCTURE OF A FRAME WITH BULBS

BACKGROUND OF THE INVENTION

A light string includes many bulb assemblies for lightening to display a certain decorative effect. The light string can only be hung without specialty and it is known that it is always provided with a frame, which is patterned. But the light string is hung and winded on the frame without any firm connection. After a period of use, the light string would be usually fallen or loosen from the frame. Hence, the decorative effect is lost.

Accordingly, the present invention is to provide a positioning structure of a frame for engaging with the bulb assembly of a light string in secure and solute the drawback of prior art.

DETAILED DESCRIPTION OF THE PREFERRED EMBODIMENT

Figure 1:
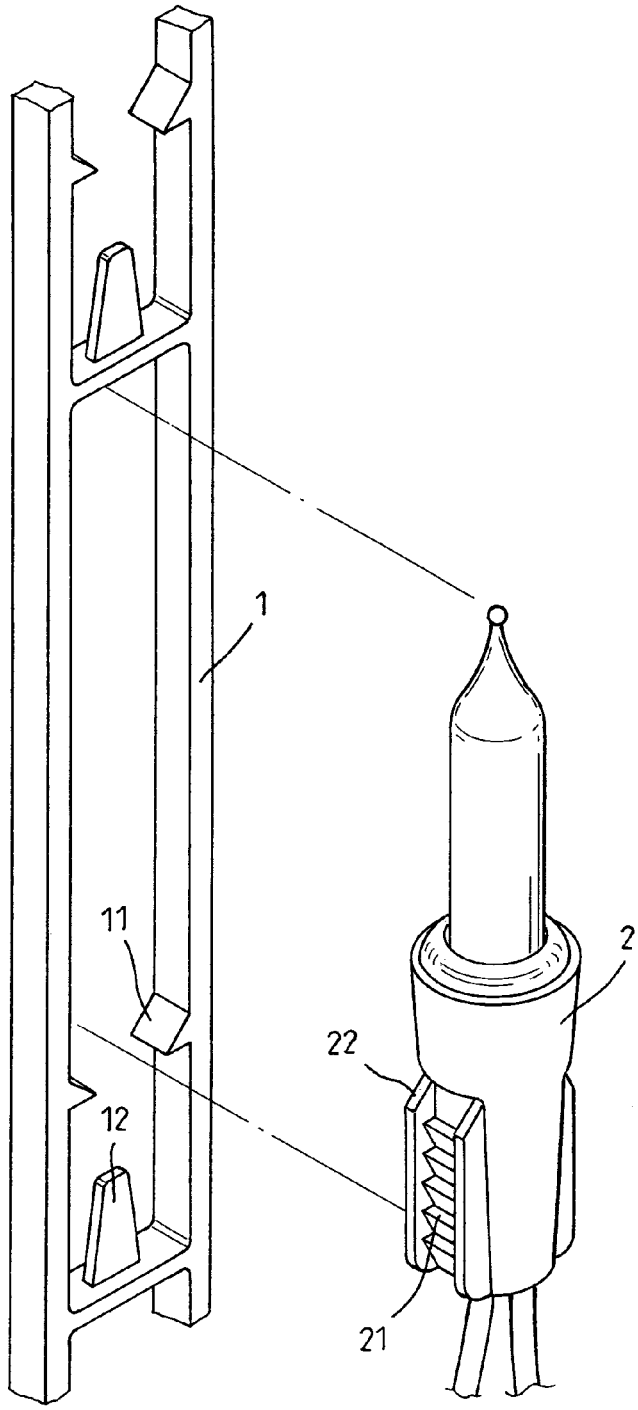
FIG. 1 is a perspective view showing a part of a frame according to the present invention with a bulb assembly.
Figure 2:
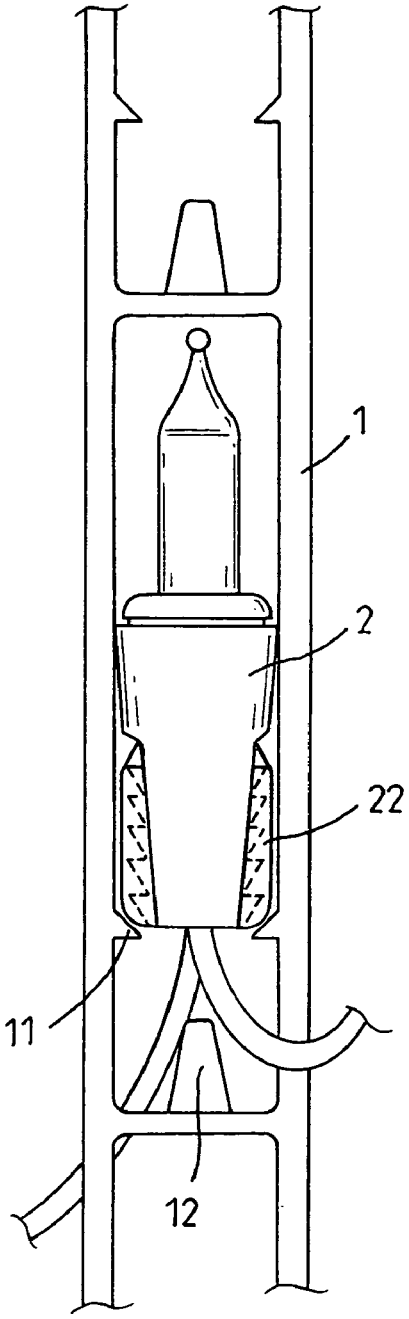
FIG. 2 is a plan view of FIG. 1 showing the bulb assembly is received in the frame.
Figure 3:
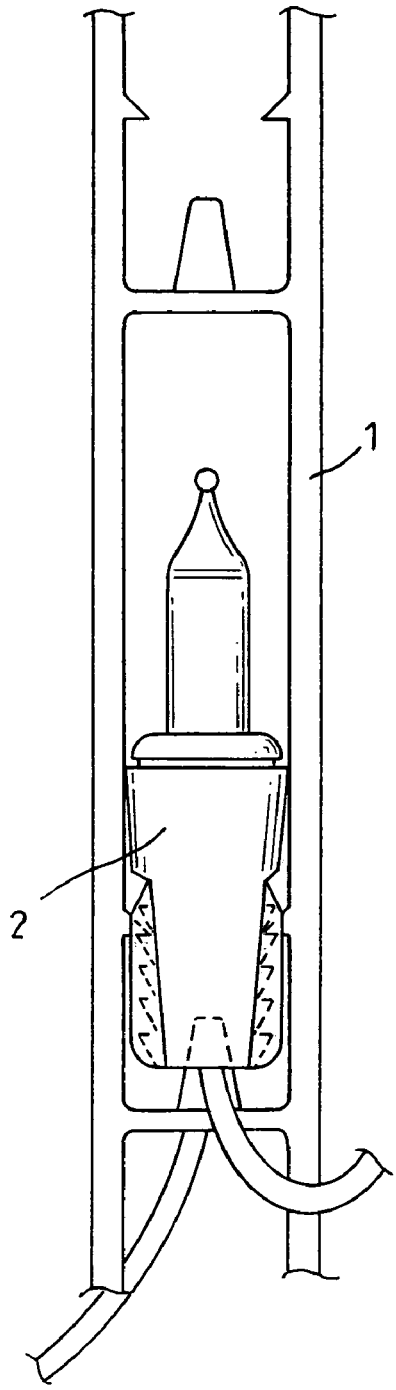
FIG. 3 is a plan view of FIG. 2 showing the bulb assembly is completely engaged with the positioning structure of the frame.

Please referring to FIG. 1 to 3 firstly, the present invention relates to a positioning structure of a frame (1) for engaging with a bulb holder (2) of the bulb assembly. The frame (1) can be patterned as desired and is provided with many separated spaces. In each space of the frame (1), pair of inward engaging portion (11) is formed at both sides and a plate (12) is formed at bottom position. The bulb assembly includes a bulb holder (2) and a bulb, wherein the holder (2) is provided with a zigzag portion (21) with two side wall-plates (22).

Figure 4:
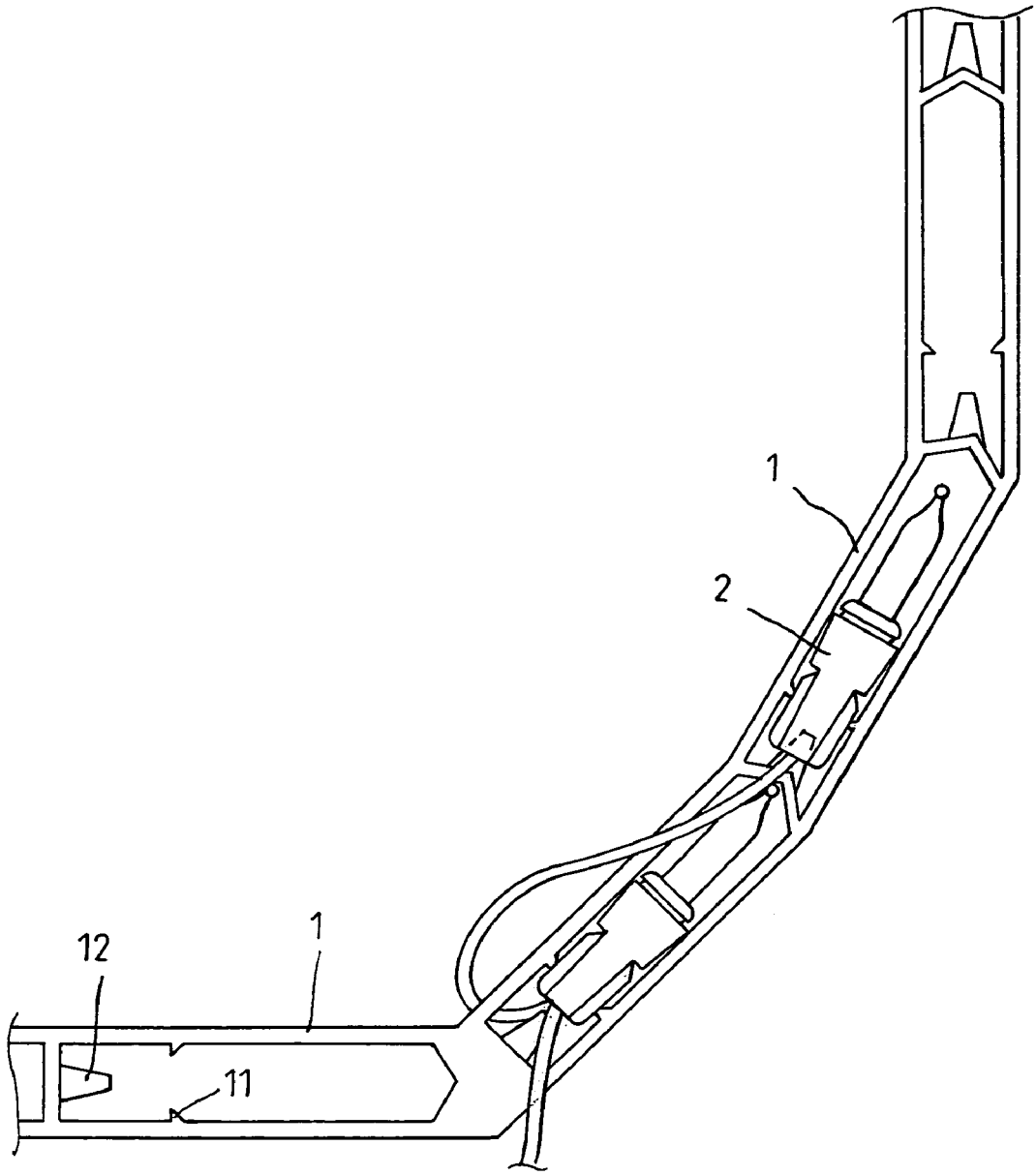
FIG. 4 is a plan view showing a large portion of the frame connecting with bulb assemblies according to the present invention.

As the bulb assembly is put into the space of the frame (1), the zigzag portion (21) can be moved downward through the engaging portion (11) from the position of FIG. 2 to FIG. 3 possibly, since the lower inclined face is provided. It obtains a securely connection between the bulb assembly and the frame (1) and at the same time, the plate (12) of the frame inserts into the bottom of the bulb holder (2) that separates two electrical wires of the bulb assembly and increases the engagement of both, as shown in FIG. 4.

Figure 5:
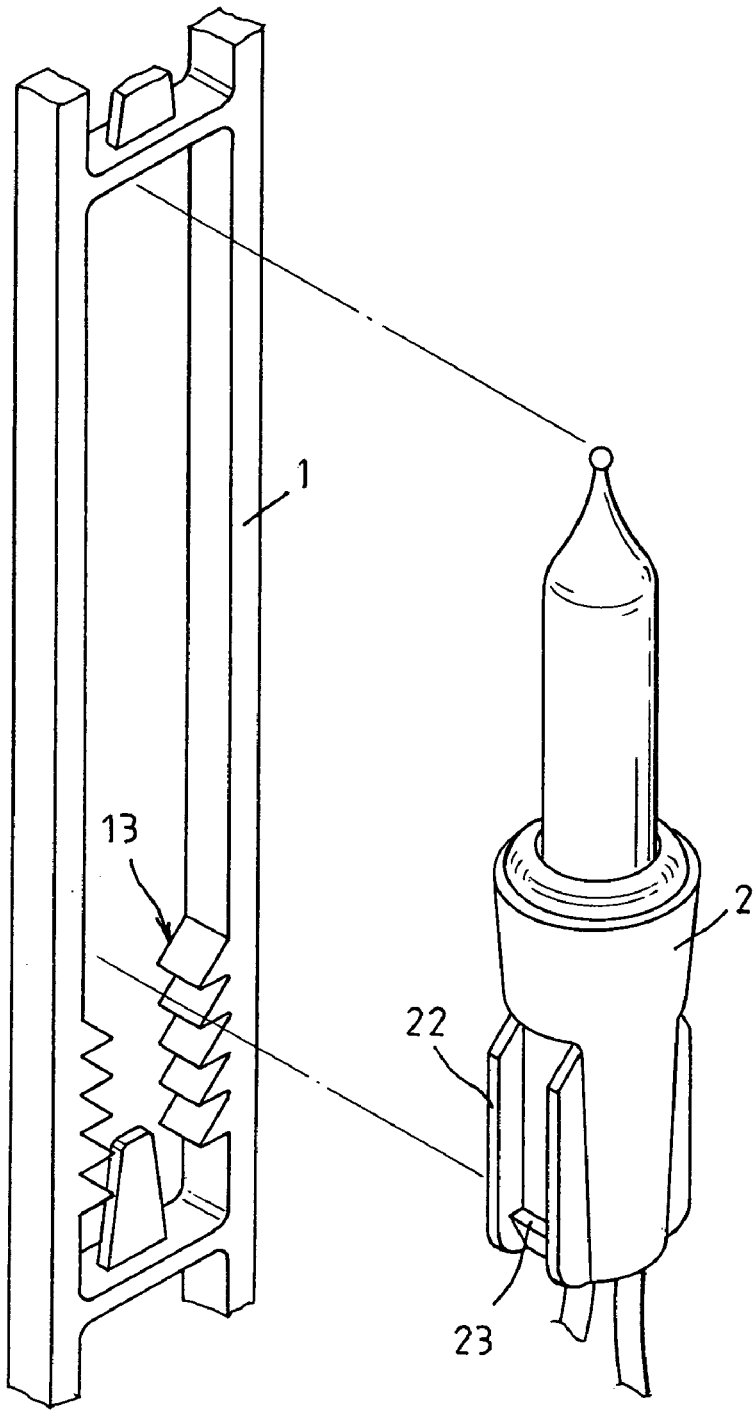
FIG. 5 is a perspective view showing another embodiment of the frame with a different positioning structure.
Figure 6:
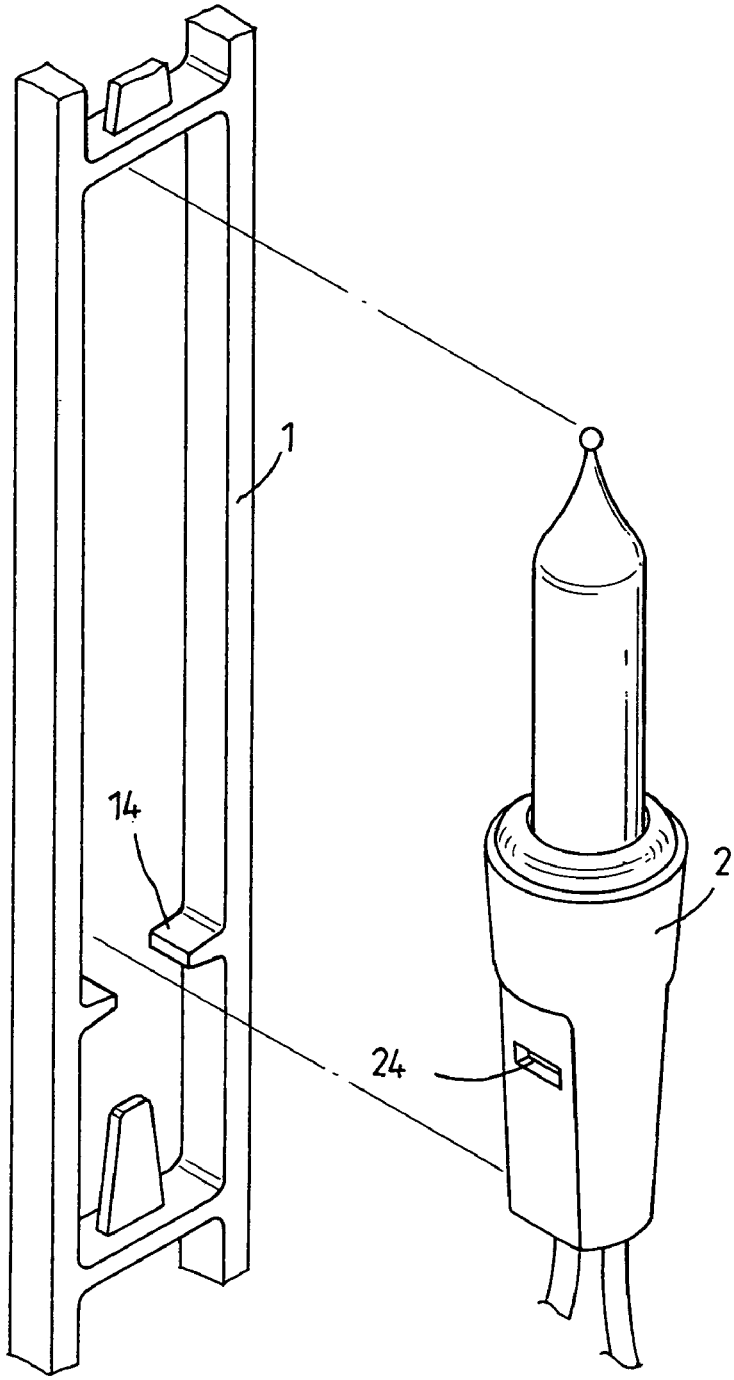
FIG. 6 is a perspective view showing a further embodiment of the frame with a different positioning structure.

Accordingly, the positioning structure provided by the present invention obtains a firm connection for a light string with a patterned frame that provides a perfect decorative effect. But the structure mentioned above is only an exemplary embodiment, it can be modified anyway, such as shown in FIG. 5, the zigzag portion (13) is formed on the frame (1) while the engaging portion (23) is provided within the side wall-plates (22). And FIG. 6 shows another embodiment according to the present invention. A projection (14) on the frame (1) and a hole (24) on the bulb holder (24) can provide a similar effect. The modified embodiments will all be claimed in this invention.

I claim:

1. A positioning structure of a frame with a bulb assembly including a patterned frame provided with many separated spaces, wherein engaging portions are formed in each space, and the bulb holder of the bulb assembly provided with side zigzag portions between wall-plates for engaging with the engaging portions of the frame to obtain secure connection between the frame and a light string.

2. A positioning structure of a frame with a bulb assembly as claimed in claim 1, wherein the zigzag portion is formed in the frame while the engaging portion is formed on the bulb holder between the wall-plates.

3. A positioning structure of a frame with a bulb assembly as claimed in claim 1, wherein a projection is formed on the frame and a hole is formed on the bulb holder, both of which can be engaged in secure and positioning.

* * * * *